US005956846A

United States Patent [19]

Ross et al.

[11] Patent Number: 5,956,846

[45] Date of Patent: Sep. 28, 1999

[54] METHOD AND APPARATUS FOR CONTROLLED ATMOSPHERE BRAZING OF UNWELDED TUBES

[75] Inventors: Gary R. Ross, Ann Arbor, Mich.; James R. Bacoccini, Toledo, Ohio

[73] Assignee: Livernois Research & Development Co., Dearborn, Mich.

[21] Appl. No.: 08/822,161

[22] Filed: Mar. 21, 1997

[51] Int. Cl.[6] ..... F28D 1/053; F28F 9/16

[52] U.S. Cl. ..... 29/890.043; 29/89.054; 165/153; 165/173; 165/178; 165/905

[58] Field of Search ..... 165/177, 183, 165/133, 905, 153, 173, 178; 29/890.043, 890.054

[56] References Cited

U.S. PATENT DOCUMENTS

| | | | |
|---|---|---|---|
| 4,574,878 | 3/1986 | Sugiyama et al. | 165/905 X |
| 4,636,356 | 1/1987 | Iwasaki et al. | 165/905 X |
| 4,716,959 | 1/1988 | Aoki | 165/905 X |
| 4,825,941 | 5/1989 | Hoshino et al. | 165/153 X |
| 4,949,543 | 8/1990 | Cottone et al. | 165/133 X |
| 4,991,647 | 2/1991 | Kawabe et al. | 165/905 X |
| 5,054,549 | 10/1991 | Nakaguro | 165/133 |
| 5,579,837 | 12/1996 | Yu et al. | 165/183 |

FOREIGN PATENT DOCUMENTS

| | | | |
|---|---|---|---|
| 302232 | 2/1989 | European Pat. Off. | 165/177 |

*Primary Examiner*—Leonard Leo
*Attorney, Agent, or Firm*—Brooks & Kushman, P.C.

[57] ABSTRACT

A heat exchanger assembly with a first header, a second header, a plurality of seamed or folded type heat exchanger tubes extending between the two headers, and a plurality of heat exchanger fins. Each of the plurality of fins has between 0.01% and 0.9% magnesium to improve the braze between the header and tube joint and the tube seam to inner surface joint. Additionally, the headers have a cladded inner surface with between about 0% to about 12.6% silicon to improve the braze at the tube-to-header joint.

15 Claims, 2 Drawing Sheets

METHOD AND APPARATUS FOR CONTROLLED ATMOSPHERE BRAZING OF UNWELDED TUBES

TECHNICAL FIELD

The present invention relates to a method and apparatus for manufacturing a heat transfer device.

BACKGROUND ART

Prior heat exchangers have included a plurality of round or oval tubes having a smooth or seamless surface that are typically formed by welding These welded tubes have an unconstricted flow passage and are attached to a pair of headers to form a heat exchanger assembly. The tubes are joined to the headers by either vacuum brazing or controlled atmosphere brazing ("CAB"). Vacuum brazing and CAB are well known in the art.

Vacuum brazing is furnace brazing in a vacuum that eliminates the need for any flux. In operation, the assembly is heated in a furnace up to brazing temperature which takes about an average of 15 minutes. The assembly is then held at brazing temperature for about 1 minute and then quenched or air-cooled as necessary. Controlled atmosphere brazing ("CAB") is widely used for the production of high quality joints. CAB is not intended to perform the primary cleaning operation for the removal of oxides or other foreign materials from the parts to be brazed. Accordingly, fluxes are used with a controlled atmosphere to prevent the formation of oxides and to break up the oxide surface to make the surface more wettable.

These brazing techniques form a sufficiently strong bond between the headers and the prior round or oval tubes. Recently, folded-type or seamed tubes have been developed for use in heat exchangers. These tubes have a constricted flow passage. When the above described brazing techniques are applied to folded-type or seamed heat exchanger tubes, they yield a weak tube-to-header joint that can result in leakage of heat exchanger fluid or other failure of the heat exchanger apparatus under the combined influence of heat, vibration, and pulsating pressure. The primary cause of the weak tube-to-header joints is a poor fillet at the tube-to-header joint. Additionally, a poor fillet also occurs between the folded seam and inner surface of the tube. If the bond is weak at either of these locations, leakage of heat exchange fluid from the tubes results. The bond must also be strong if the heat exchangers are used in automobiles to withstand high vibrations, high temperatures, and long periods of use.

Various corrective techniques have been attempted to provide a better fillet at the tube-to-header joint and between the tube fold and tube inner surface. For example, elevating the brazing temperatures and increasing the brazing cycle times were two attempted techniques. However, these techniques removed even more cladded filler (fillet) from the surface of the headers, resulting in an even weaker tube-to-header bond.

Other corrective techniques included increasing the amount of clad on the outside of the folded-type tubes or using clad on the inside of the folded-type tubes. These techniques did not provide any appreciable increase in strength between the tube-to-header joint or tube fold to inner surface joint and only resulted in wasting the excess clad added to the tubes, resulting in increased cost. Another technique included utilizing cladded fins in the heat exchanger. However, this also increased the cost without providing any appreciable change in the strength of the tube-to-header joint or tube fold to inner surface joint.

Another attempt to increase the bond at the tube-to-header joint and the tube fold to inner surface joint was to resize the tubes after assembly was completed. However, this also failed to provide any appreciable increase in strength of the tube-to-header joint or tube fold to inner surface joint. Thus, there has been no successful way to incorporate folded-type tubes into a heat exchanger assembly with a strong fillet at the tube-to-header joint or at the tube fold to inner surface joints.

SUMMARY OF THE INVENTION

It is an object of the present invention to provide a method and apparatus for increasing the strength of the bond between the heat exchanger tubes and headers by providing a good fillet at the tube-to-header joints.

It is yet another object of the present invention to provide a method and apparatus for increasing the strength of the bond between the tube fold and tube inner surface joints.

It is a further object of the present invention to provide a heat exchanger assembly that decreases the amount of capillary action and prevents excess clad from leaving the surfaces to be joined.

The present invention provides a heat exchanger apparatus including a first header, a second header, a plurality of heat exchanger tubes, and a plurality of uncladded heat exchanger fins. The plurality of heat exchanger tubes are of a folded type and have a seam extending across an entire surface of each tube. The plurality of fins are located between a pair of heat exchanger tubes. The fins are comprised of an aluminum alloy containing between about 0.01% to about 0.9% magnesium to decrease the amount of capillary action and limit the amount of clad that is removed from the surface of the headers and tube to increase the wetability of the headers, and to provide a band at the surfaces to be joined.

The present invention also provides headers with a cladded surface. The clad or filler is comprised of an aluminum silicon mix, with a reduced amount of silicon, thus reducing the time and temperature of brazing at the tube-to-header joint, thus increasing the strength of the bond between the surfaces to be joined.

Additional features and advantages of the present invention will become apparent to one of skill in the art upon consideration of the following detailed description of the present invention.

BEST MODE FOR CARRYING OUT THE INVENTION

Figure 1:
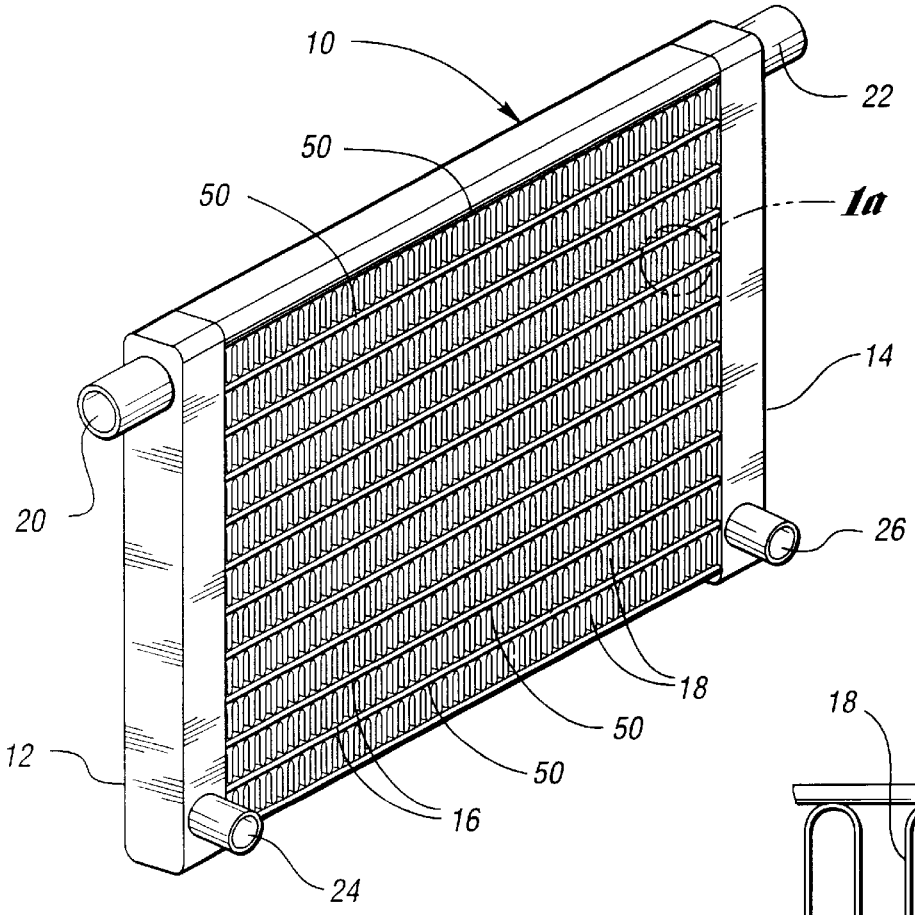
FIG. 1 is a perspective view of a heat exchanger apparatus in accordance with a preferred embodiment of the present invention.

FIG. 1 illustrates a heat exchanger assembly 10 in accordance with a preferred embodiment of the present invention.

The heat exchanger assembly 10 includes a first header 12, a second header 14, a plurality of heat exchanger tubes 16 extending between the first header 12 and the second header 14, and a plurality of heat exchanger fins 18 with each fin positioned between and supporting a pair of heat exchanger tubes 18. The heat exchanger assembly 10 also includes a first entrance opening 20 formed in the first header 12, a second entrance opening 22 formed in the second header 14, a first exit opening 24, formed in the first header 12, and a second exit opening 26 formed in the second header 14.

In operation, a heat exchange fluid, such as a coolant, flows into the plurality of heat exchanger tubes 16 through the entrance openings 20, 22 and contacts the heat exchange medium, such as warm air, passing through the assembly 10. The heat exchange fluid and the heat exchange medium effectuate a heat transfer as is well known in the art before the heat exchange fluid exits the assembly through exit openings 24, 26. It should be understood that the heat exchange fluid can be any warm or cold liquid or warm or cold gas. Similarly, the heat exchange medium can be either a warm or cold gas.

The various parts of the heat exchanger assembly 10 can be manufactured into a complete assembly by vacuum brazing, controlled atmosphere brazing or other conventionally available methods. However, the preferred method of manufacture is by controlled atmosphere brazing.

The first header 12 and the second header 14 have an inner surface 28 that has a layer of cladded filler (clad). The clad helps join the tubes 16 to the headers 12, 14. The clad on the headers 12, 14 is preferably an aluminum silicon alloy with a composition to be discussed in more detail herein. During brazing, the clad on the surface headers 12, 14 is heated to a temperature where it liquifies and joins the tubes 16 to the headers 12, 14 to form an integral single part. In the preferred embodiment, the outside surfaces of the tubes 16 are also cladded. During brazing, the clad on the surfaces of the tubes 16 will liquify and join the folds of the tubes 16 to the tube inner surface.

In the preferred embodiment, both the headers and the tubes are comprised of an aluminum alloy that is approximately 98% pure. (In this disclosure, all percentages are in weight percent). However, other materials can be used and still be formed by brazing. Additionally, the headers can be of a different material than the tubes.

Figure 2:
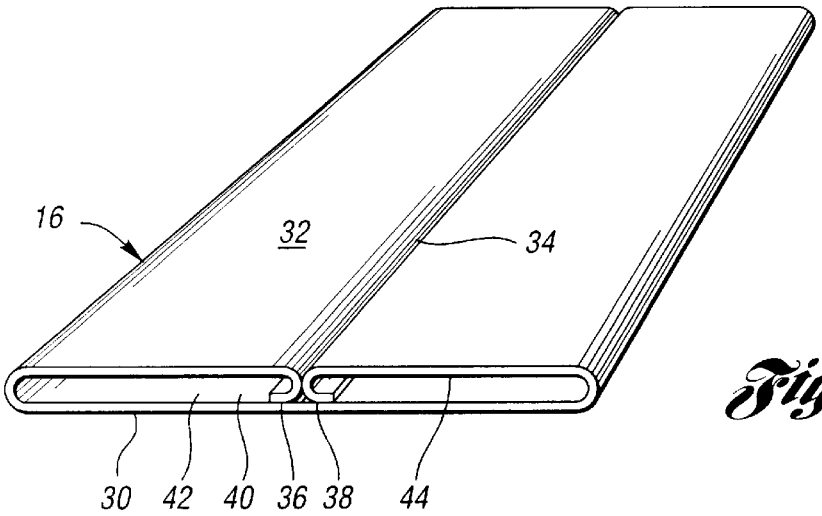
FIG. 2 is a perspective view of a folded heat exchanger tube in accordance with a preferred embodiment of the present invention.

FIG. 2 illustrates a folded-type or seamed heat exchanger tube 16 in accordance with a preferred embodiment of the present invention. The heat exchanger tubes 16 are preferably formed by folding. The resultant tubes 16 have a bottom surface 30 and a top surface 32. The top surface 32 has a seam 34 formed therein by preferably folding the ends 36, 38 of the metal sheet used to manufacture the tubes 16. The ends 36, 38 are folded into contact with the inner sides 40 of the bottom surfaces 30 of the tubes 16. Each tube 16 also has a pair of passageways 42, 44 formed therein through which the heat exchange fluid flows. The passageways 42, 44 have a generally constricted cross-section.

Figure 3:
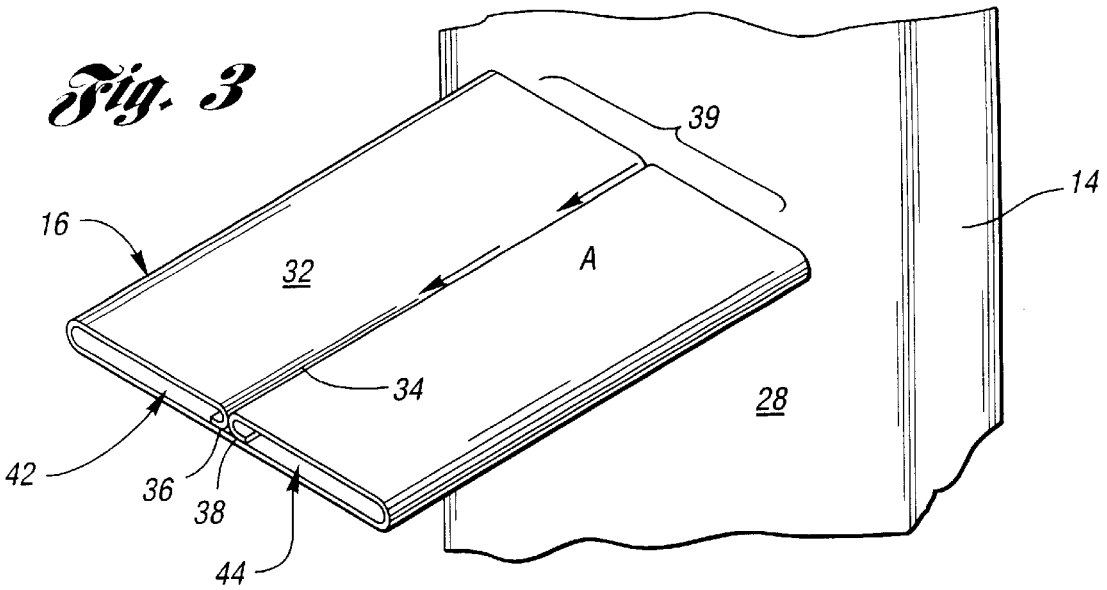
FIG. 3 is a schematic view illustrating the effect of capillary action that occurs at the tube-to-header joint.

FIG. 3 is a schematic illustration of a heat exchanger tube-to-header joint 39. As discussed above, when heat exchangers with folded tubes are brazed, a weaker tube-to-header joint is formed with the seamed tubes than with heat exchangers with seamless tubes. It has been discovered that this is due to a number of reasons. One reason for the weak bond is that the seam 34 in the tubes allows for capillary action of the clad. Capillary action is the effect of the clad on the inner surface 28 of the headers 12, 14 liquefying and traveling along the folded seam 34 in the top surface 32 of the tubes 16 (as shown by the arrows A) and away from the joints needed to be bonded. The clad will liquify when the base material is heated to a certain temperature. If enough clad is removed from the headers 12, 14, the tubes 16 will not be effectively seamed to the headers 12, 14. Capillary action occurs because after the clad liquifies, it travels to the source of greatest heat which is the center of the core. Accordingly, a good fillet joining the heat exchanger tubes to the headers is not formed.

Figure 1A:
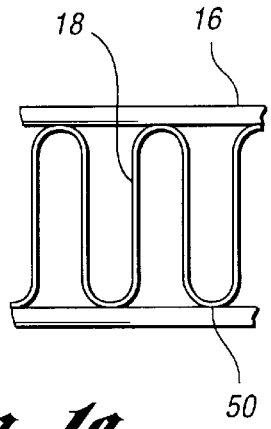
FIG. 1*a* is an enlarged sectional view of the circled portion of FIG. 1.
Figure 4:
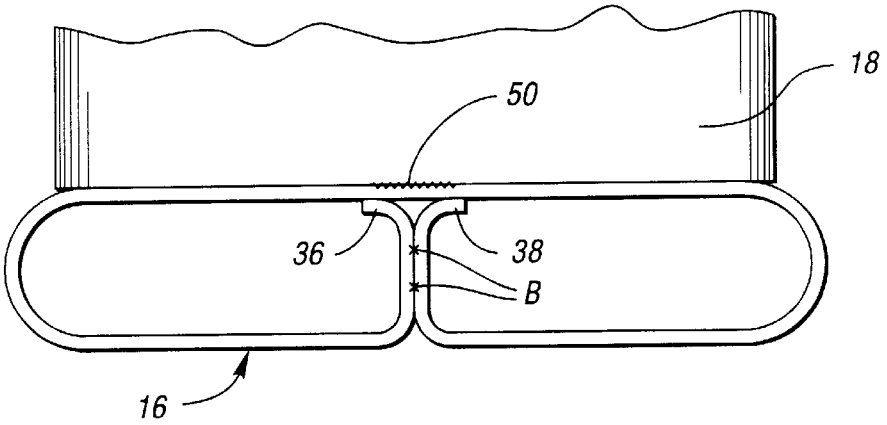
FIG. 4 is a cross-sectional view illustrating the capillary action that occurs at the seam to inner surface joint.

It has been discovered that the liquid clad is also being pulled from the tubes 16 to the fin fillet joint 50 (FIG. 1*a*, 4) on the top or seam side 32 of the heat exchanger tubes 16. The clad wants to travel to this contact area between the tubes 16 and fins 18 because the fins heat up quicker than the tubes since they are thinner and may have different metallurgical compositions than the tubes. Accordingly, these heat sources pull the clad material off the headers 12, 14 and through capillary action form fillets at the tube-to-fin contact area 50 on the seam side 32 of the tubes 16, as shown by the arrows B in FIG. 4. This results in a poor fillet at the tube-to-header joint 39, as well as a poor fillet at the end 36, 38 to inner surface 40 joint. In order to stop the flow of clad to the fin 16, heat transfer between the tube 16 and fin 18 needs to be prevented. By preventing this heat transfer, the flow of clad from the headers to the tubes and then to the fins through capillary action is similarly prevented.

In order to prevent the forming of these fillets on the tube-to-fin contact area 50, the fins 16 are manufactured from an aluminum alloy with about 0.01% to about 0.90% of magnesium. Through experimentation, it has been determined that less than 0.01% of magnesium will not significantly increase the strength of the tube inner seam bonds. Additionally, any more than 0.9% magnesium is overkill and unnecessary. However, the scope of the appended claim is not intended to preclude fins with more than 0.9% magnesium.

It has been discovered that the magnesium makes the contact area 50 between the fin and the tubes less wettable and thus harder to braze. Accordingly, a magnesium alloy in the fins will minimize the fillet on the tube-to-fin area 50, while at the same time, maximizing the fillet on the tube-to-header joint 39, as well as on the tube seam to inner surface joint 36, 38. Fins are typically manufactured with 0% magnesium if the heat exchanger is to be brazed by controlled atmosphere brazing. For fins that have typically been brazed by vacuum brazing, they have contained between 1–2% magnesium. Thus, in accordance with the preferred embodiment of the present invention, if the assembly to be brazed by CAB, magnesium is added to the fins. If the assembly is to be brazed by vacuum brazing, magnesium is removed from the fins. The fins are preferably uncladded because clad on the fins does not add any additional bonding strength when compared to the cost. However, cladded fins may be incorporated into the disclosed heat exchanger.

The above percentages of magnesium are determined by the overall matrix size of the assembly as well as the fin weight per inch, the desired fillet size (fillet-to-tube) and the time and temperature of brazing. Thus, the percentage of magnesium in the fins will vary. By using increased amounts of magnesium in the base fin material, this causes a blocking action in the fin fillet, as the size of the fillet is controlled by the amount of magnesium used.

Additionally, it has also been determined that the header-to-tube bond can be further improved by reducing the amount of silicon used in the clad on the header inner surface 28. The silicon causes the clad on the inner surface 28 of the headers 12, 14 to liquify at lower temperatures than the aluminum. Moreover, if some of the silicon is removed, a higher temperature is needed before the clad will liquify and form the bond. This prevents the filler material (clad) on the header 12, 14 from becoming a liquid before the clad on the tubes 16 becomes a liquid. Thus, the cladded tubes will come up to brazing temperature before the clad on the header surfaces 28. This will also minimize the amount of capillary action and increase strength of the bond between the tubes and the header. The amount of silicon in the clad on the header surface 28 can range from between about 0% to about 12.6%, but is preferably between about 9.0% and about 11.0%. Additionally, reducing the amount of silicon in the clad will also reduce the cost of manufacturing the assembly. If the amount of silicon is above about 12.6%, the silicon will liquify at lower temperatures than the clad on the tubes.

While only one preferred embodiment of the invention has been described hereinabcve, those of ordinary skill in the art will recognize that this embodiment may be modified and altered without departing from the central spirit and scope of the invention. Thus, the embodiment described hereinabove is to be considered in all respects as illustrative and not restrictive, the scope of the invention being indicated by the appended claims, rather than by the foregoing descriptions, and all changes which come within the meaning and range of equivalency of the claims are intended to be embraced herein.

What is claimed is:

1. A method of manufacturing a heat transfer device, comprising:

a) providing a plurality of heat transfer folded-type tubes, each having an inner surface which ducts a fluid coolant, the inner surface being uncladded and an outer cladded surface, each having a first and a second end, a seamless bottom surface and a seamed top surface defined by folding a first edge and a second edge of a sheet inwardly toward and into contact with the inner surface;

b) providing a first header for attachment to said first end of said plurality of heat transfer tubes, said header having a cladded inner surface;

c) providing a second header for attachment to said second end of said plurality of heat transfer tubes, said header having a cladded inner surface;

d) providing a plurality of heat transfer fins having between about 0.01 w % and about 0.9 w % magnesium to block the flow of molten clad away from the heat transfer tubes to the plurality of heat transfer fins, and from the headers to the heat transfer tubes, with one of said plurality of heat transfer fins being positioned between two of said plurality of heat transfer tubes; and e) brazing said plurality of heat transfer tubes, said first header, said second header, and said plurality of heat transfer fins to provide a strong joint with a fillet where said first and second ends of said plurality of heat transfer tubes attach to said first and second headers, respectively, and where the inwardly folded edges meet the seamless bottom surface of each tube, and where the plurality of heat transfer fins meet the heat transfer tubes.

2. The method of claim 1, wherein said heat transfer device is a heat exchanger.

3. The method of claim 2, wherein said heat exchanger is a radiator for use in an automobile.

4. The method of claim 1, wherein both said cladded surfaces of said first and second headers include clad with between about 0.05 w % and about 12.6 w % silicon.

5. The method of claim 1, wherein said plurality of heat transfer tubes are formed of an aluminum alloy.

6. The method of claim 1, wherein said brazing step is controlled atmosphere brazing.

7. The method of claim 1, wherein said said brazing step is vacuum brazing.

8. A heat transfer assembly comprising:

a first header having an inner cladded surface and an outer uncladded surface;

a second header having an inner cladded surface and an outer uncladded surface;

a plurality of heat exchanger tubes, each having a first end for attachment to said first header and a second end for attachment to said second header, each tube having an inner coolant-contacting uncladded surface and an outer cladded surface, and a seamless bottom surface and a seamed top surface defined by a sheet with folded first and second edges, which inwardly extend toward and contact the inner surface; and a plurality of heat exchanger fins with each of said fins being positioned between a respective pair of said plurality of seamed heat exchanger tubes, each of said plurality of heat exchanger fins being comprised of an aluminum alloy having between about 0.01 w % and about 0.9 w % magnesium to block the flow of molten clad away from the heat transfer tubes to the plurality of heat transfer fins, and from the headers to the heat transfer tubes.

9. The heat exchanger assembly of claim 8, wherein said plurality of heat exchanger tubes are folded.

10. The heat exchanger assembly of claim 8 wherein said plurality of heat exchanger tubes are cladded.

11. The heat exchanger assembly of claim 8, wherein each of said plurality of heat exchanger fins have a plurality of louvers formed therein.

12. The heat exchanger assembly of claim 8, wherein said plurality of seamed heat exchanger tubes are folded-type heat exchanger tubes.

13. The heat exchanger assembly of claim 8, wherein said first header is attached to said first end of said heat exchanger tubes and said second header is attached to said second end of said heat exchanger tubes by controlled atmosphere brazing.

14. The heat exchanger assembly of claim 8, wherein said first header is attached to said first end of said heat exchanger tubes and said second header is attached to said second end of said heat exchanger tubes by vacuum brazing.

15. The heat exchanger assembly of claim 8, wherein said first cladded header and said second cladded header have between about 0.05 w % to about 12.6 w % silicon.

* * * * *